United States Patent [19]

Copenhaver

[11] 4,403,942

[45] Sep. 13, 1983

[54] SELF-CHECKING SAFETY SWITCH CONTROL CIRCUIT

[75] Inventor: Lloyd F. Copenhaver, Indianapolis, Ind.

[73] Assignee: Carrier Corporation, Syracuse, N.Y.

[21] Appl. No.: 207,854

[22] Filed: Nov. 18, 1980

[51] Int. Cl.[3] ..... F23N 3/00; F23Q 5/00

[52] U.S. Cl. ..... 431/24; 431/6; 431/26; 126/285 B; 126/116 A; 236/1 G; 236/15 C; 340/584

[58] Field of Search ..... 431/24, 19, 21, 6, 26, 431/63; 126/116 A, 285 B; 236/1 G, 45, 1 H, 11, 15 C; 110/163; 340/584, 593, 626

[56] References Cited

U.S. PATENT DOCUMENTS

| | | | |
|---|---|---|---|
| 1,677,295 | 7/1928 | Rogers et al. | 431/24 |
| 2,157,710 | 5/1939 | Lake . | |
| 2,704,571 | 3/1955 | Reichelderfer | 431/19 X |
| 3,482,922 | 12/1969 | Blackett | 431/26 |
| 3,887,325 | 6/1975 | Finger et al. | 431/6 |
| 4,189,296 | 2/1980 | Hayes . | |

*Primary Examiner*—Larry Jones

*Attorney, Agent, or Firm*—Donald F. Daley; David L. Adour

[57] ABSTRACT

The present invention relates to a self-checking safety switch control circuit for a power combustion system. The circuit comprises a safety switch, a combustion blower relay, a thermal pilot switch, and a fuel supply system. The safety switch operates to detect flow through the combustion system. The safety switch either operates the pilot switch directly or operates the fuel supply system directly to shut down the system if no flow through the combustion system is detected. The circuit has a self-checking feature because combustion cannot be initiated in a subsequent cycle of the system if the safety switch remains in the proven condition from the previous combustion cycle.

10 Claims, 3 Drawing Figures

SELF-CHECKING SAFETY SWITCH CONTROL CIRCUIT

BACKGROUND OF THE INVENTION

The present invention relates to combustion systems and more particularly to a self-checking safety switch control circuit for a power combustion sytem. Specifically, the present invention relates to a self-checking safety switch control circuit for preventing operation of the fuel supply system of a power combustion system when a flow detector indicates that there is insufficient flow of combustion air and products of combustion through the combustion system. The circuit is self-checking because it prevents the initiation of combustion in the system if the flow detector has not returned to its pre-combustion operating condition from its condition when the system is operating normally.

Power combustion systems are those which mechanically assist the flow of combustion air and products of combustion through the combustion system. This is normally accomplished by the use of a fan or blower to either push the combustion air into the combustion chamber of the combustion system under positive pressure or to draw the products of combustion out of the combustion chamber by negative pressure. No matter how the mechanical assist is provided, almost all power combustion systems require proper operation of the assist means for combustion to proceed in a safe manner. As a result, power combustion systems generally employ some method of proving the operation of the assist means. Sail switches, pressure switches and centrifugal switches, among others, have been used for this purpose. These devices typically employ a single electrical contact which closes when proper operation of the assist means is established. This has the inherent disadvantage that if the electrical contacts weld together or if the actuating mechanism sticks or binds, the system indicates that flow is adequate even if it is not. Further, when such a failure occurs, there is no indication that the proving system is disabled.

SUMMARY OF THE INVENTION

It is an object of the present invention to provide a self-checking safety switch control circuit for a power combustion system.

It is another object of the present invention to provide a self-checking safety switch control circuit for a power combustion system which is fast acting and controls both the fuel supply system and the combustion blower motor of the combustion system.

These and other objects of the present invention are accomplished by a circuit including a safety switch, a combustion blower relay, and a thermal pilot switch. The combustion blower relay controls the operation of the combustion blower of a power combustion system. The combustion blower relay responds to either the safety switch or the thermal pilot switch. The thermal pilot switch and the safety switch control the fuel supply system of the power combustion system. The switches operate to initiate combustion and open the main fuel valve of the fuel supply system when a thermostat indicates that the combustion system should be turned on. The fuel supply system remains operating only so long as the safety switch indicates that there is proper flow through the vent system of the combustion system.

DESCRIPTION OF THE PREFERRED EMBODIMENTS

Figure 1:
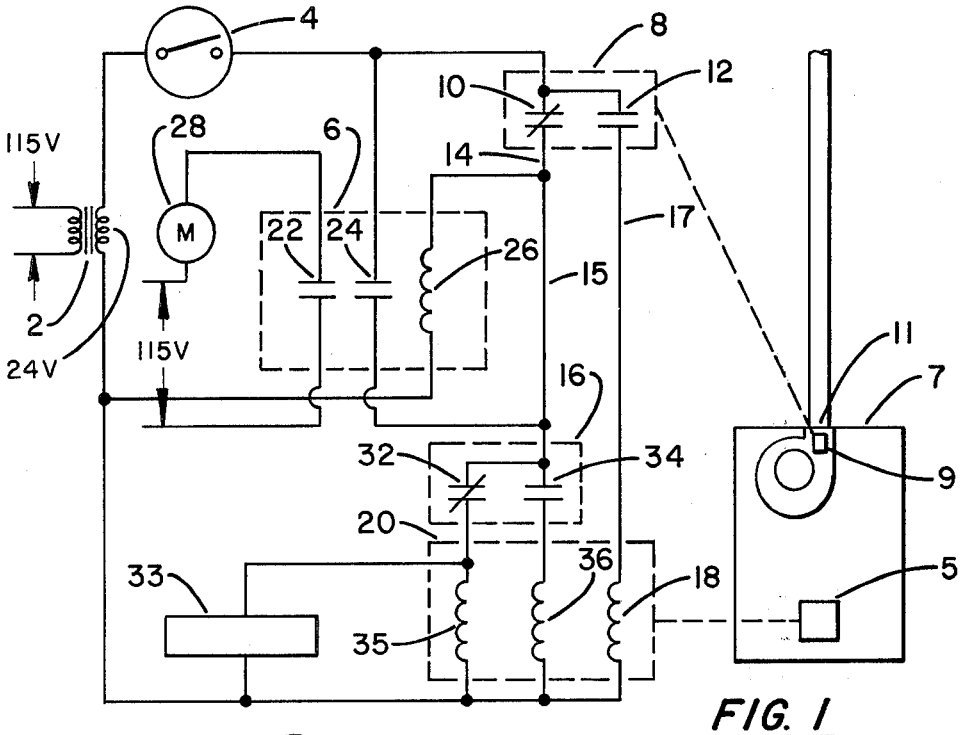
FIG. 1 shows a preferred embodiment of a self-checking safety switch control circuit constructed according to the principles of the present invention.

FIG. 1 shows a preferred embodiment of a self-checking safety switch control circuit designed according to the principles of the present invention. The circuit controls the fuel supply system 5 of a furnace 7 in response to a thermostat 4 and a safety switch 8. The safety switch 8 is preferably a sail switch 9 located in a combustion blower outlet 11 of the furnace 7. However, the safety switch 8 may be a pressure switch, centrifugal switch, or other such device. The safety switch 8 shuts down the furnace 7 if the sail switch 9 is not in the proven condition indicating that there is flow through the combustion blower outlet 11. The thermostat 4 regulates the flow of current from the main power supply 2 to the control circuit thereby controlling the initiation of a combustion cycle.

Figure 3:
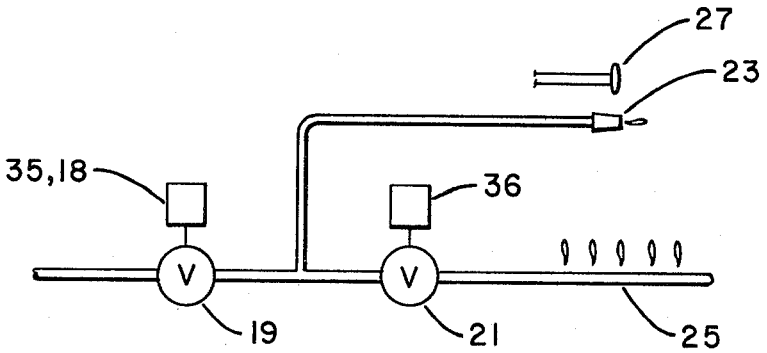
FIG. 3 depicts a fuel supply system for a combustion system having a self-checking safety switch control circuit as shown in FIGS. 1 or 2.

The operation of the fuel supply system 5 is best understood by referring to FIG. 3. The system 5 comprises a pilot fuel valve 19, a main fuel valve 21, a pilot burner 23, a main burner 25, and a pilot heat sensor 27.

The pilot fuel valve 19 controls the flow of fuel to the pilot burner 23 and the main burner 25. Pick coil 35 and hold coil 18, which are part of the fuel supply control system 20 shown in FIGS. 1 and 2, control the operation of the pilot fuel valve 19. Pick coil 35 opens the pilot fuel valve 19 when current flows through the coil 35. Hold coil 18 operates to hold open the pilot fuel valve 19 when current flows through this coil 18. However, the operation of hold coil 18 alone is not sufficient to open the pilot fuel valve 19. The sparker 33, shown in FIGS. 1 and 2, ignites the fuel at the pilot burner 23 when the fuel flows from the pilot fuel valve 19 to the pilot burner 23.

Pilot heat sensor 27 is located next to the pilot burner 23. As described with respect to FIGS. 1 and 2, this sensor 27 activates the thermal element of the pilot switch 16 to operate a warp switch in the pilot switch 16.

Figure 2:
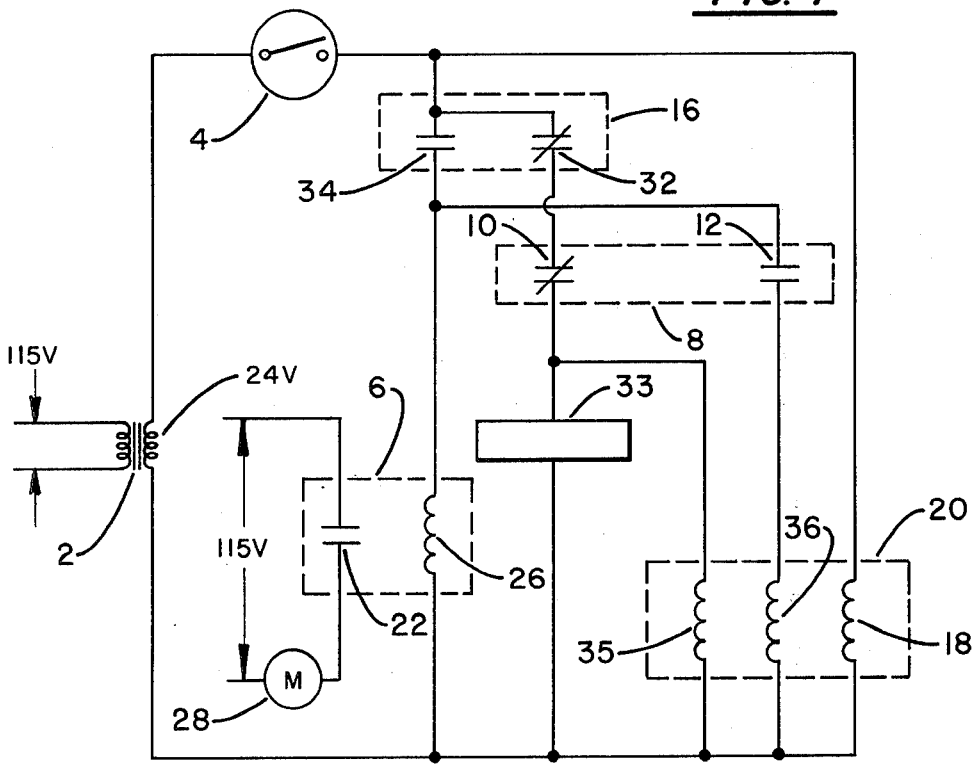
FIG. 2 shows an alternative embodiment of a self-checking safety switch control circuit constructed according to the principles of the present invention.

The coil 36, which is part of the fuel supply control system 20 shown in FIGS. 1 and 2, controls the operation of the main fuel valve 21. The coil 36 opens the main fuel valve 21 when current flows through the coil 36 and the valve 21 closes when no current is flowing through the coil 36. The flame at the pilot burner 23 ignites the fuel at the main burner 25 when the main fuel valve 21 opens allowing fuel to flow to the main burner 25.

The circuit elements of the self-checking safety switch control circuits shown in FIG. 1 are connected as follows: a 24 volt A.C. power supply 2 is electrically connected to the thermostat 4 which in turn is connected to a combustion blower relay 6 and the safety switch 8. The safety switch 8 and the combustion relay 6 are electrically connected in parallel. The safety switch 8 has a normally closed contact 10 and a normally open contact 12. The normally closed contact 10 has its output lead 14 connected to a thermal pilot switch 16. The normally opened contact 12 has its output lead 17 connected to a hold coil 18 within the fuel supply system 5 of the furnace 7. The hold coil 18 has its output lead connected to the main power supply 2 to form a complete circuit comprising thermostat 4, safety switch 8, hold coil 18 and main power supply 2. The combustion blower relay 6 has a first switch 22, a second switch 24 and a coil 26. The coil 26 is connected in series with the normally closed contact 10 of the safety switch 8 through the output lead 14. The switch 24 is connected in parallel to the safety switch 8 and in series with the thermal pilot switch 16. The switch 22 is part of a separate circuit containing a combustion blower motor 28, and a 115 volt A.C. power supply electrically connected in series with the switch 22. The thermal pilot switch 16 has a normally closed contact 32 and a normally open contact 34. The normally closed contact 32 is connected in series with a sparker 33 and a pick coil 35. The output leads from the sparker 33 and pick coil 35 are connected to each other and are connected to the main power supply 2 to form another complete circuit. The normally open contact 34 is connected in series with the fuel supply control system 20 and controls the operation of the main fuel valve coil 36. The output lead from the main fuel valve coil 36 is connected to the output leads from the pick coil 35 and sparker 33 and connected to the main power supply 2. The fuel supply control system 20 includes a hold coil 18 which is also electrically connected to the output leads from the pick coil 35 and main fuel valve coil 36 to the main power supply 2 to form a complete circuit with the thermostat 4, and the normally open contact 12 of the safety switch 8.

Normally the thermostat 4 is open, the safety switch contact 10 is closed, the pilot switch contact 32 is closed and the fuel supply system 5 is shut down when the furnace 7 is not operating. When the thermostat 4 closes the circuit is completed to safety switch 8 through the contact 10 to the pilot switch 16 through the contact 32 to the sparker 33 and pick coil 35. Also, the circuit formed by the safety switch 8 through contact 10 to the relay coil 26 is completed. The flow of current through the relay coil 26 causes the switches 22 and 24 to close. Closing the switch 22 causes the combustion blower motor 28 to operate thereby turning on the combustion blower. Also, the switch 24 closes to create a holding circuit including closed switch 24, conductor 15 and coil 26. The pilot switch 16 completes a circuit to the pick coil 35 and sparker 33 to initiate the flow of fuel through the pilot fuel supply valve and to ignite the fuel.

The turning on of the combustion blower motor 28 creates a flow through the furnace 7 resulting in the actuation of sail switch 9 and safety switch 8 to close contact 12 and open contact 10. Closing contact 12 allows current to flow to the hold coil 18 in the fuel supply system 20. The hold coil 18 holds open the pilot fuel valve 19 of the fuel supply system 5 which has initially been opened by the operation of the pick coil 35. One feature of hold coil 18 is that it provides only enough power to hold open the pilot fuel valve 19 and cannot open the valve 19 from the closed position. The more powerful pick coil 35 is needed to open the pilot fuel valve 19 from the closed position.

The main fuel valve 21 is opened after a timme delay in the operation of thermal pilot switch 16 which closes contact 34 and opens contact 32. The time delay is accomplished by a warp switch or other such device which is a part of the pilot switch 16. The warp switch comprises a thermal element which is at a relatively low temperature when the combustion system is not operating. At this low temperature the thermal element is positioned so that contact 34 of the pilot switch 16 is open and contact 32 is closed. When combustion is initiated by the opening of the pilot fuel supply valve 19 and the operation of the sparker 33 the pilot flame is used to heat the thermal element. As the thermal element is heated it gradually expands so that first the contact 32 is opened and then, after a slight additional time delay, the contact 34 is closed. Closing contact 34 allows current to flow through the main fuel valve coil 36 to open the main fuel valve 21 of the fuel supply system 5. Opening the main fuel valve 21 results in the initiation of steady state combustion in the combustion chamber of the furnace 7. Under normal operating conditions the furnace 7 and the control circuit maintain this steady state operation until the thermostat 4 is opened and the furnace 7 returns to its non-operating state. The furnace 7 is then ready to go through another combustion cycle.

However, if a malfunction should occur so that flow through the combustion blower outlet 11 is prevented, the safety switch 8 will close. That is, contact 12 opens and contact 10 closes. Opening contact 12 prevents the flow of current to the hold coil 18 thereby closing the pilot fuel supply valve 19 and shutting down the fuel supply system 5 of the furnace 7.

The control circuit shown in FIG. 1 has the additional feature of self-checking. That is, if the furnace 7 has operated properly on the previous cycle and the thermostat 4 has opened to shut down the system but the safety switch 8 remains in the proven condition; that is, contact 12 remains closed and contact 10 remains open, the fuel supply system 5 is disabled during the next operating cycle of the furnace 7. This is accomplished since during the next operating cycle the contact 10 is open preventing current flow to the combustion blower relay 6 and pilot switch 16. No current is supplied to the pilot switch 16 nor to the blower relay 6 thereby preventing the initiation of combustion and preventing the combustion blower from being turned on.

FIG. 2 shows an alternative embodiment of a self-checking safety switch control circuit. The same reference numerals are used to identify the elements shown in FIG. 2 corresponding to identical elements shown in FIG. 1. The circuit differs from the circuit shown in FIG. 1 in the arrangement of the thermal pilot switch 16 and the safety switch 8. The thermal pilot switch 16 is located prior to the safety switch 8 in the circuit shown in FIG. 2. Also, the circuit in FIG. 2 does not utilize a switch 24 in the combustion blower relay 6 as shown in FIG. 1. The circuit shown in FIG. 2 does retain the self-checking feature since the initiation of combustion will not occur on a subsequent cycle after the safety switch 8 has remained in the proven condition from the previous operating cycle.

In operation, the control circuit shown in FIG. 2, is similar to the operation of the control circuit shown in FIG. 1. Initially, normally closed contact 32 in thermal pilot switch 16 is closed, normally closed contact 10 in safety switch 8 is closed and the thermostat switch 4 open when the furnace 7 is not operating. However, when the thermostat 4 closes, a circuit from the contact 32 of the thermal pilot switch 16 and through the contact 10 of the safety switch 8 is completed to pick coil 35 and sparker 33. This initiates the flow of fuel through the pilot fuel supply valve 19 and ignites the fuel. After a predetermined delay time due to the operation of a warp switch or other such device the thermal pilot switch 16 operates to open the normally closed contact 32 turning off the pick coil 35 and the sparker 33. The pilot fuel valve remains open after pick coil 35 is deenergized due to the flow of current through hold coil 18. After a slight additional time delay the thermal pilot switch 16 closes the normally open contact 34 allowing current to flow through the relay coil 26 to close the contact 22 completing the circuit between the secondary power supply 30 and the combustion blower motor 28. The combustion blower motor 28 operates to create a flow through the furnace 7 which actuates safety switch 8 of the furnace 7 thereby causing the normally open contact 12 of the safety switch 8 to close, causing the normally closed contact 10 to open, and completing the circuit through main fuel valve coil 36. This results in the furnace 7 operating in its steady state mode with the hold coil 18 operating to hold open the pilot fuel valve 19 in the fuel supply system 5.

If the combustion blower motor 28 malfunctions or if another malfunction should occur so that there is no flow through the vent system, the safety switch contact 12 opens and contact 10 closes. This cuts off the flow of current to the main fuel valve coil 36 thereby closing the main fuel valve 21 and shutting down the furnace 7. Thus, in the circuit shown in FIG. 2 the safety switch 8 directly controls the operation of the main fuel valve coil 36. The operation of the main fuel valve 21 in response to the fuel valve coil 36 and safety switch 8 is usually slower than the operation of the pilot fuel valve 19 in response to the hold coil 18 and the pilot switch 16. Thus, the circuit depicted in FIG. 1, is usually faster acting and operates to immediately close down the fuel supply system 20 if the safety switch 8 indicates a malfunction.

While two specific embodiments of the present invention have been depicted and described, it should be understood that various modifications may be made without departing from the scope of this invention. Therefore, it is to be understood that the present invention encompasses these variations in view of the invention heretofore described and claimed in the appended claims.

What is claimed is:

1. Electrical controls for a combustion system of the type having a vent system with a flow sensor for detecting flow of air and products of combustion through the vent system, a blower for mechanically assisting the flow of air and products of combustion through the combustion system, a fuel supply system including a main fuel valve which controls fuel flow to main burners of the combustion system and a pilot fuel valve which controls fuel flow to the main fuel valve and to a pilot burner, a sparker which operates to ignite fuel flowing from the pilot burner, and a thermostat for connecting the electrical controls to a main electrical power supply in response to a demand for combustion and for disconnecting the electrical controls from the main electrical power supply when the demand for combustion is satisfied, said electrical controls comprising:

safety switch circuit means for proving operation of the flow sensor when the electrical controls are connected to the main electrical power supply by the thermostat and for terminating operation of the combustion system when the flow sensor detects no flow through the vent system during operation of the combustion system;

ignition circuit means for operating the sparker to ignite fuel flowing from the pilot burner when the pilot fuel valve is opened;

blower circuit means for turning on the blower when operation of the pilot burner is established; and combustion circuit means for opening the pilot fuel valve only when the operation of the flow sensor is proven by the safety switch circuit means and for opening the main fuel valve only when the flow sensor detects flow through the vent system after operation of the pilot burner is established and the blower is turned on.

2. Electrical controls for a combustion system as recited in claim 1 wherein the safety switch circuit means includes:

a pair of electrical contacts which are connected to the flow sensor and which are in a first operating state with the first contact closed and the second contact open when the flow sensor detects no flow through the vent system and which are in a second operating state with the first contact open and the second contact closed when the flow sensor detects flow through the vent system.

3. Electrical controls for a combustion system as recited in claim 2 wherein the combustion circuit means includes:

a pilot switch means, electrically connected to the first contact of the safety switch circuit means and to the thermostat for receivng electrical power from the main power supply only when the thermostat connects the controls to the main electrical power supply and the first contact of the safety switch circuit means is closed, for sensing combustion at the pilot burner, for supplying the electrical power received from the main power supply to a first output lead when no combustion is sensed at the pilot burner, and for supplying the electrical power received from the main power supply to a second output lead after combustion has been sensed at the pilot burner for a selected time duration; and a fuel supply control system having a pick coil electrically connected to the first output lead of the pilot switch means for opening the pilot fuel valve when electrical power is supplied from the main power supply to the pick coil, a main coil electrically connected to the second output lead of the pilot switch means for opening the main fuel valve when electrical power is supplied from the main power supply to the main coil, and a hold coil electrically connected to the second contact of the safety switch circuit means for holding open the pilot fuel valve when electrical power is supplied from the main power supply to the hold coil.

4. Electrical controls for a combustion system as recited in claim 3 wherein the blower circuit means includes:

blower motor means for operating the blower when said blower motor means is energized;

a blower motor switch means for energizing the blower motor means when said blower motor switch means is activated; and relay coil means, electrically connected to the first contact of the safety switch circuit means and to the main electrical power supply, and located in electrical relationship with the blower motor switch means, for activating the blower motor switch means when the thermostat connects the electrical controls to the main electrical power supply and the first contact of the safety switch circuit means is closed, and for maintaining activation of the blower motor switch means after the first contact of the safety switch circuit means is opened until the thermostat disconnects the electrical controls from the main electrical power supply.

5. Electrical controls for a combustion system as recited in claim 2 wherein the combustion circuit means includes:

a pilot switch means, electrically connected to the thermostat, for receiving electrical power from the main electrical power supply when the thermostat connects the controls to the main electrical power supply, for sensing combustion at the pilot burner, for supplying electrical power received from the main power supply to a first output lead when no combustion is sensed at the pilot burner, and for supplying electrical power received from the main power supply to a second output lead after combustion has been sensed at the pilot burner for a selected time duration; and a fuel supply control system having a pick coil electrically connected through the first contact of the safety switch circuit means to the first output lead of the pilot switch means for opening the pilot fuel valve when electrical power is supplied from the main electrical power supply to the pick coil, a main coil electrically connected through the second contact of the safety switch circuit means to the second output lead of the pilot switch means for opening the main fuel valve when electrical power is supplied from the main electrical power supply to the main coil, and a hold coil electrically connected to the thermostat for holding open the pilot fuel valve when electrical power is supplied from the main electrical power supply through the thermostat to the hold coil.

6. Electrical controls for a combustion system as recited in claim 5 wherein the blower circuit means includes:

blower motor means for operating the blower when said blower motor means is energized;

a blower motor switch means for energizing the blower motor means when said blower motor switch means is activated; and a relay coil electrically connected to the second output lead of the pilot switch means for activating the blower motor switch means when the thermostat connects the controls to the main electrical power supply and electrical power is supplied by the pilot switch means to the second output lead.

7. An electrical circuit for controlling the fuel supply system of a combustion system, comprising:

a main power supply;

a thermostat electrically connected in series with the main power supply;

safety switch means for sensing flow of air and products of combustion through the combustion system, the safety switch means having a first contact which is closed when there is no flow through the combustion system and which is open when there is flow through the combustion system and a second contact which is closed when there is flow through the combustion system and is open when there is no flow through the combustion system, the switch means being electrically connected in series with the thermostat;

a combustion blower relay having a relay coil, a first switch, and a second switch, the relay coil electrically connected in series with the first contact of the safety switch means and connected to the main power supply to form a first complete circuit, the first switch electrically connected in series with the thermostat, in parallel with the safety switch means, and in electrical relationship with the relay coil whereby the first switch is closed when there is current flowing through the relay coil and is open when there is no current flowing through the relay coil, and the second switch electrically connected in series with a secondary power supply and a combustion blower motor to form a separate complete electrical circuit and the second switch in electrical relationship with the relay coil whereby the second switch is closed when there is current flowing through the relay coil and is open when there is no current flowing through the relay coil;

a pilot switch electrically connected in series with the first contact of the safety switch means, the pilot switch having a first pilot switch contact which is normally closed when the combustion system is not operating and which opens after a fixed time period during which combustion is sensed at a pilot burner of the combustion system and having a second pilot switch contact which is normally open when the combustion system is not operating and which closes after the first pilot switch contact is opened in response to continued sensed combustion at the pilot burner;

a sparker electrically connected in series with the first pilot switch contact and in series with the main power supply to form a second complete circuit; and a fuel supply means having a pick coil, a main fuel valve coil, and a hold coil, for controlling the flow of fuel to the burner of the combustion system, the pick coil electrically connected in series with the first pilot switch contact and in series with the main power supply to form a third complete circuit, the main fuel valve coil electrically connected in series with the second pilot switch contact and in series with the main power supply to form a fourth complete circuit, and the hold coil electrically connected in series with the second contact of the safety switch means and in series with the main power supply to form a fifth complete electrical circuit.

8. The circuit as recited in claim 7 wherein the safety switch means includes a sail switch for detecting flow through the combustion system whereby when no flow is detected the first safety switch contact is closed and the second safety switch contact is open and when flow is detected the first safety switch contact is opened and the second safety switch contact is closed.

9. A circuit for controlling the fuel supply system of a combustion system, comprising:

a main power supply;

a thermostat electrically connected in series with the main power supply;

a pilot switch electrically connected in series with the first contact of the safety switch means, the pilot switch having a first pilot switch contact which is closed when the combustion system is not operating and which opens after a fixed time period during which combustion is sensed at a pilot burner of the combustion sytem and having a second pilot switch contact which is normally open when the combustion system is not operating and which closes after the first pilot switch contact is opened in response to continued sensed combustion at the pilot burner;

a combustion blower relay having a relay coil and a relay switch, the relay coil electrically connected in series with the main power supply to form a first complete electrical circuit, the relay switch electrically connected in series with a combustion blower motor and a secondary power supply to form a separate complete electrical circuit and in electrical relationship with the relay coil whereby the relay switch is open when no current flows through the relay coil and is closed when current is flowing through the relay coil;

a safety switch means for sensing flow of air and products of combustion through the combustion system, the safety switch means having a first safety switch contact which is closed when there is no flow through the combustion system and is open when there is flow through the combustion system and which is connected in series with the second pilot switch contact and having a second safety switch contact which is open when there is no flow through the combustion system and is closed when there is flow through the combustion system and which is connected in series with the first pilot switch contact;

a sparker electrically connected in series with the first safety switch contact and in series with the main power supply to form a second complete electrical circuit; and a fuel supply means having a pick coil, a main fuel valve coil, and a hold coil, for controlling the flow of fuel to the burner, the pick coil connected in series with the first safety switch contact and in series with the main power supply to form a third complete circuit, the main fuel valve coil electrically connected in series with the second safety switch contact and in series with the main power supply to form a fourth complete circuit, and the hold coil electrically connected in series with the thermostat, in parallel to the pilot switch and in series with the main power supply to form a fifth complete circuit.

10. The circuit as recited in claim 9, wherein the safety switch means includes a sail switch for detecting flow through the combustion system whereby when no flow is detected the first safety switch contact is closed and the second safety switch contact is open and when flow is detected the first safety switch contact is opened and the second safety switch contact is closed.

* * * * *